US005419794A

United States Patent [19]

Hauber et al.

[11] Patent Number: 5,419,794

[45] Date of Patent: May 30, 1995

[54] METHOD AND APPARATUS FOR MANUFACTURING TEXTILE

[75] Inventors: Michael Hauber, Weinheim; Ulrich Freudenberg, Sinsheim; Christoph Josefiak, Rimbach; Peter Barth, Birkenau; Bernd Dietrich, Aachern, all of Germany

[73] Assignee: Firma Carl Freudenberg, Weinheim, Germany

[21] Appl. No.: 166,056

[22] Filed: Dec. 10, 1993

[30] Foreign Application Priority Data

Dec. 10, 1992 [DE] Germany ..... 42 41 514.4

[51] Int. Cl.[6] ..... D04H 3/07

[52] U.S. Cl. ..... 156/167; 264/8; 425/8

[58] Field of Search ..... 156/167, 272.6, 441, 156/62.4; 264/7, 8, 22, 131; 425/8, 174, 174.8 E; 65/459, 469, 470, 455

[56] References Cited

U.S. PATENT DOCUMENTS

| | | | |
|---|---|---|---|
| 3,357,807 | 12/1967 | Stalego | 156/62.4 |
| 4,215,682 | 8/1980 | Kubik et al. | 264/22 |
| 4,277,436 | 7/1981 | Shah et al. | 264/518 |
| 4,440,700 | 4/1984 | Okada et al. | 264/8 |
| 4,666,782 | 5/1987 | Tada et al. | 428/423 |
| 4,790,736 | 12/1988 | Keuchel | 425/66 |
| 4,865,755 | 9/1989 | Lloyd | 156/167 |
| 4,898,634 | 2/1990 | Keuchel | 156/167 |
| 4,937,020 | 6/1990 | Wagner et al. | 264/6 |
| 5,112,677 | 5/1992 | Tani et al. | 428/317.9 |
| 5,123,949 | 6/1992 | Thiessen | 264/8 |
| 5,173,356 | 12/1992 | Eaton et al. | 428/296 |

FOREIGN PATENT DOCUMENTS

| | | | |
|---|---|---|---|
| 628644 | 2/1963 | Belgium | 264/131 |
| 1155619 | 10/1983 | Canada . | |
| 43218 | 4/1975 | Japan | 264/131 |

*Primary Examiner*—Steven D. Maki
*Attorney, Agent, or Firm*—Kenyon & Kenyon

[57] ABSTRACT

Method and device for producing a flat textile structure in which a melt of a polymer material is changed to the form of fibers with the aid of a spinning rotor. The still sticky fibers are impacted with a mixture of hot gas particles; the particles are then ionized in a high-voltage electrical field for longer duration of the filter effect.

17 Claims, 4 Drawing Sheets

METHOD AND APPARATUS FOR MANUFACTURING TEXTILE

RELATED APPLICATION

This application is related to a U.S. patent application entitled "Method and Device for Manufacturing a Spun Fleece" which claims priority from German Application No. P42 41 517.9 (M. Hauber et al.), the contents of which is incorporated herein by reference.

BACKGROUND OF THE INVENTION

The invention relates to a method for manufacturing a flat textile structure in which a melt of a polymer material is changed to the form of fibers with the aid of a spinning rotor and in which the fibers are then combined and solidified to form a flat structure.

Fleece-spinning methods permit manufacture of very fine fiber fleece which, depending on the composition of the starting materials and their subsequent processing, exhibits different material properties.

Centrifugal spinning methods have been known for many years. They have their origin in glass fiber production and have also been used for some time to process polymer materials. Methods for manufacturing fiber fleece are explained in the following patents: U.S. Pat. No. 4,666,782; U.S. Pat. No. 4,790,736; U.S. Pat. No. 4,898,634; U.S. Pat. No. 4,440,700; U.S. Pat. No. 4,937,020; U.S. Pat. No. 4,277,436; and Canadian Patent 1,155,619. The contents of each of these patents is incorporated herein by reference in their entirety.

In the methods for manufacturing fiber fleece from synthetic material set forth in these patents, a polymer granulate is usually melted in an extruder and delivered at a pressure of up to 200 bars to a spinning rotor rotating at 3,000 to 11,000 rpm. The rotor typically is heated by means of electrical heating elements. The fibers emerging radially from the spinning rotor are then deflected and solidified and laid down on a conveyor belt to form a flat structure.

The methods used to lay down fine fiber-fleece fibers as a fleece are often very complicated and cumbersome, as described, for example, in DE PS 3 215 810 C2. If the fibers are fed through a liquid cooling medium, additional drying of the webs is also necessary.

In the known methods for statically electrically charging fiber fleece for filtration purposes, discharge often occurs after relatively short usage of the filter element, resulting in a significantly reduced filter effect.

There remains a need for an improved technique for manufacturing a flat textile such that filter elements made of fiber fleece remain capable of carrying filtration-effective charges even after prolonged use.

SUMMARY OF THE INVENTION

This invention meets this need as the fibers, after emerging from the spinning rotor and while still sticky, come in contact with an air stream to which solid particles have been fed before striking the fibers. The solid particles scattered into the air stream before impacting the fibers attach to the still sticky surfaces of the fibers emerging from the spinning rotor. The composition of the particles employed to this end is a function of the filter element application desired. For example, barium titanate particles are dipoles which form agglomerates at room temperature and hence neutralize their charge. If such particles are heated by means of the air stream to temperatures of more than 120° C., they lose their charge. In this state, the particles in a uniform distribution land on the still plastic fiber surface facing the air stream and stick to the fibers. This "pretzel" effect has the advantage that no separate adhesive is used that could negatively affect the filter effect of the structure. As the size of the particles applied increases, the filter effect of the fiber fleece is further improved.

In a further feature, the fibers are exposed to ionizing radiation immediately after they are impacted. As a result of the ionizing radiation, filter-effective charges build up on the fibers impacted by the particles, and the fibers thus remain effective even after prolonged use for filtration.

After shaping and solidification, the fibers can be laid down continuously and progressively on a backing fleece. The suction hood, which can be arranged in an annular fashion around the spinning rotor and which also surrounds the backing and covering materials, ensures coating of the webs with the particle-impregnated fibers carrying a charge. The webs are then laminated by roller pairs and can be wound up at a winding station.

Also provided is a device comprising a spinning rotor which can be given a rotational movement around its axis, with exit openings and first auxiliary means (i.e., the backing) movable parallel to the axis for continuous capture of the fibers emerging from the outlet openings.

A device for manufacturing spun fiber fleece should be simple in design, operate reliably and largely maintenance-free, and simultaneously be able to process a wide variety of starting products into as many end products as possible.

Centrifugal spinning devices have been known for many years and are explained in the following: EP 0 071 085 A1, EP 0 168 817 A2, DE 3 105 784 A1, DE 3 215 810 C2, DE 3 801 080 A1, U.S. Pt. No. 4,277,436 (the contents of these patents are incorporated herein by reference).

In the devices known from the art, however, it is important to note that as a result of the high pressure at which the melt is usually fed into the spinning rotor, a seal is required between the fixed and moving parts. The seal is subject to wear—when it is damaged, downtime can result for the entire system. Even centrifugal fleece-spinning devices in which the molten polymer material is fed largely at zero pressure into the spinning rotor, are not designed to produce fiber fleece for filtration purposes that is statically chargeable for a long duration.

A further feature of this invention is that it provides an improved device that can be used to make a fleece that still bears filtration-effective charges even after prolonged use as a filtration element.

This feature is achieved according to the invention by virtue of a second auxiliary means for continuously supplying gas to the outlet openings is arranged axially adjacent to the spinning rotor, as well as a third auxiliary means for continuously supplying solid particles to the gas. The second and third auxiliary means are arranged so close axially to the spinning rotor that the mixture of hot gas particles is conveyed by the boundary layer flow, produced at the circumference of the spinning rotor by its rotation, to the still sticky fibers at the outlet openings.

This spinning rotor can have an annular nozzle located in front of it in the axial direction, said nozzle having an outlet opening facing the outer circumference of the spinning rotor. As a result, the hot gas with the particles contained therein is conveyed by a boundary layer flow generated by the spinning rotor along the outer circumference of the spinning rotor to the still plastic fibers.

The particle collector can likewise be mounted ahead of the spinning rotor in the axial direction and has an outlet opening terminating, for example, in the annular nozzle.

This arrangement of the particle storage device and annular nozzle has been found to be especially advantageous. It allows compact dimensions for the device and a problem-free introduction of the particles into the hot gas stream. Charging the gas in the boundary layer flow with particles added from outside the annular nozzle is significantly more cumbersome from the design standpoint and poses problems because of the required uniform distribution of the particles over the circumference of the spinning rotor.

It is advantageous that the cross section of the outlet opening of the particle container be variable. The amount of particles supplied to the hot gas can be thus varied at any time without great difficulty. Then a wide variety of different particles, varying by size and shape, can be processed in the system.

The spinning rotor is surrounded radially by corona elements for electrostatically charging the fibers, said corona elements being arranged axially and adjacent on both sides with respect to the radial plane of the outlet openings. As soon as the fibers emerge from the spinning rotor, they are guided by a high-voltage field and their charge carriers align themselves. Then a filtration-effective charge develops on the fibers which remains effective even after prolonged use of the fibers as a filter.

The corona elements are annular and, depending on the spinning rotor, can be permanently mounted relative to the rotor. By virtue of the annular shape and the fixed mounting, even at high rotational speeds of the spinning head, imbalances in the device can be avoided. In addition, with fixed corona elements, rotary inertial forces do not develop. Changes in rotational speed and correction of this speed for spinning can thus be performed more rapidly and precisely.

BRIEF DESCRIPTION OF THE DRAWINGS

For a more complete understanding of the invention, reference should now be made to the embodiment illustrated schematically in greater detail in the accompanying drawings and described below. In the drawings.

DETAILED DESCRIPTION

Figure 1:
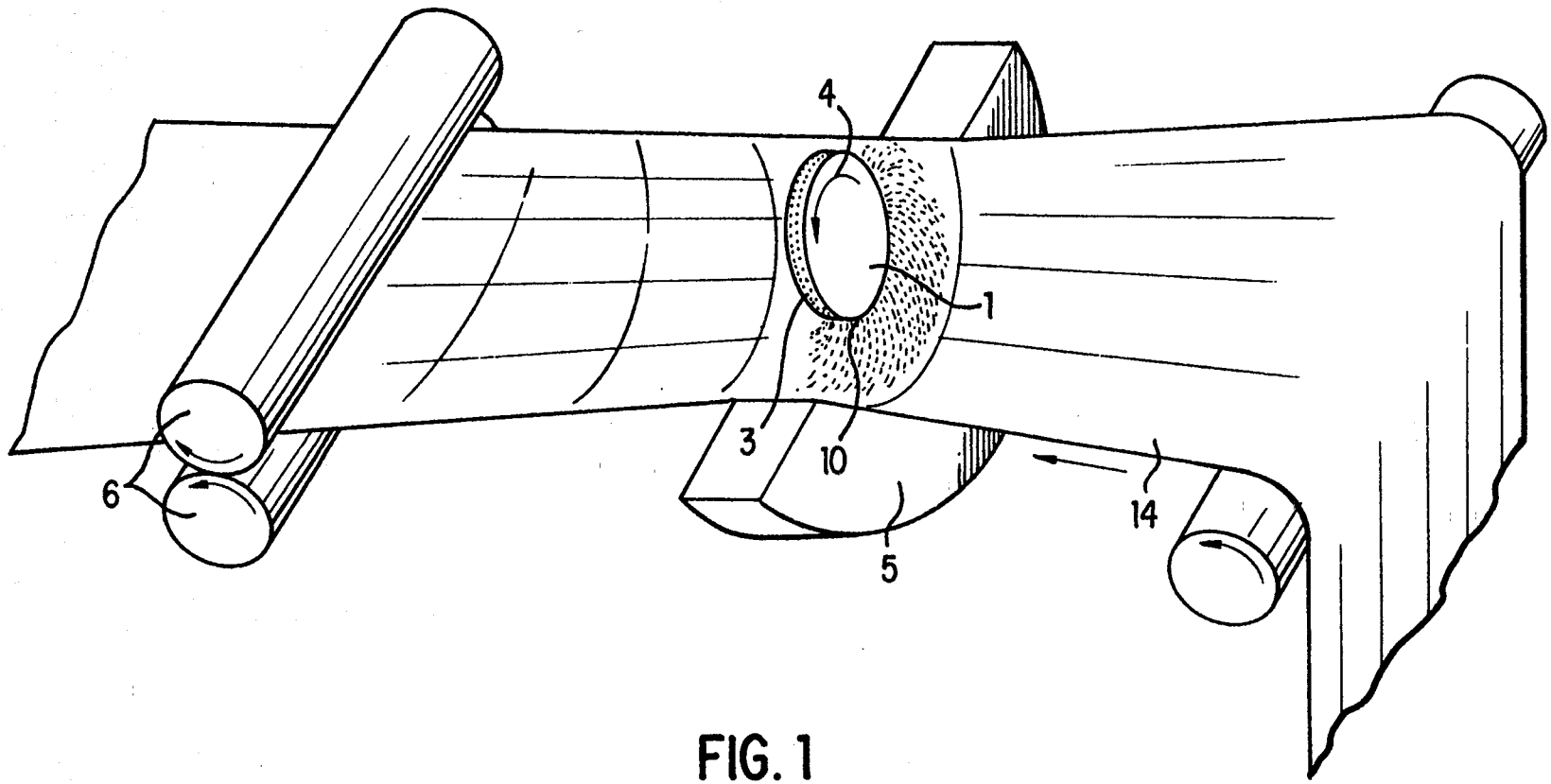
FIG. 1 is a schematic view of the invention.

FIG. 1 shows a schematic arrangement of the device according to the invention. To simplify the illustration of the operation of the device, covering material 15 (see FIG. 3) and the upper part of suction hood 5 are not shown in this Figure. By rotation of spinning head 1, a centrifugal force is exerted on the polymer melt in spinning head 1. The melt moves toward the inner circumference of spinning head 1 in front of nozzles 3 and depending on the rotational speed 4 of spinning head 1 (and therefore as a function of the centrifugal force) and the viscosity of the melt, is forced through nozzles 3 into space. The plurality of still-plastic fibers 10 emerging from nozzles 3 is stretched considerably by the braking action of the air, centrifugal force, and their own inertia.

Backing material 14 and cover material 15 move past nozzles 3 in the axial direction with respect to spinning head 1. Spinning head 1 is surrounded radially by backing material 14 and covering material 15. The fibers, after solidifying, are carried continuously through a suction hood 5 to be laid down progressively on backing fleece 14 and covering fleece 15.

In roller nip 6, the two material webs coated with very fine fleece 16 are laminated and can be wound up at a winding station not shown in the drawing.

Figure 2:
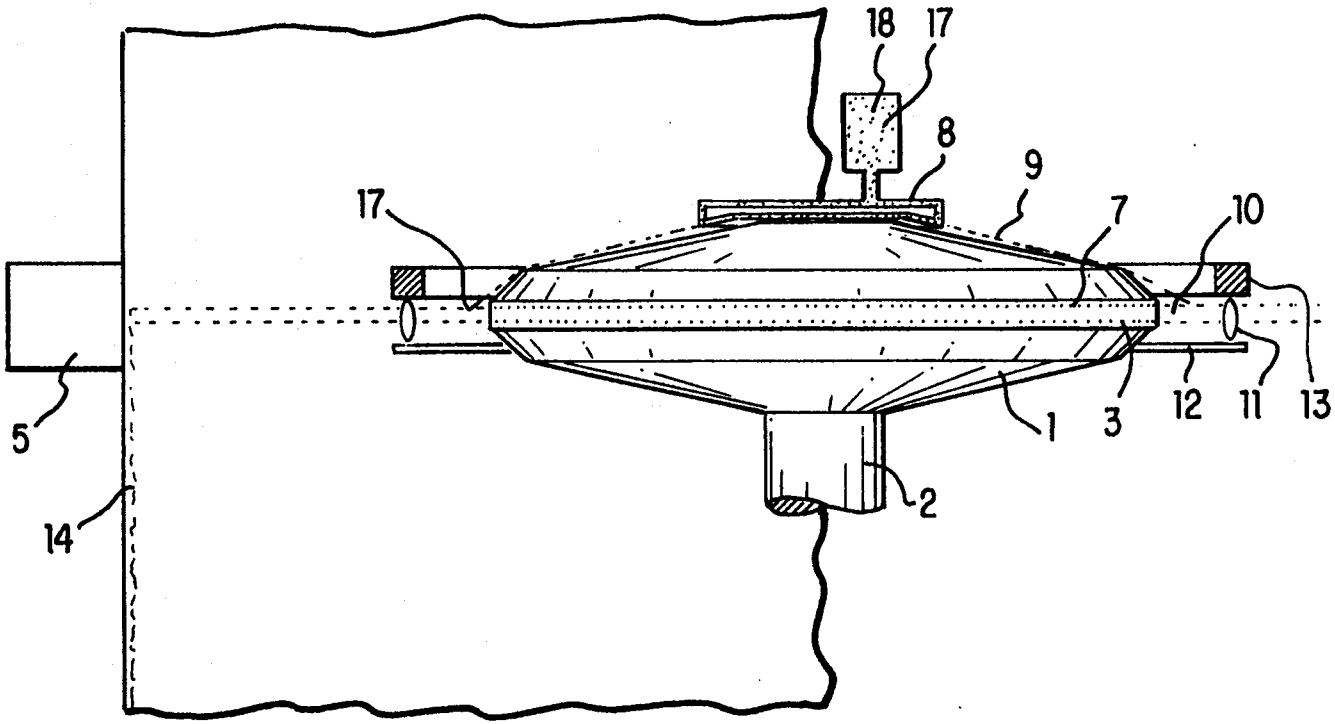
FIG. 2 is a partial sectional view of a spinning rotor head.

FIG. 2 shows a spinning head 1 with a nozzle ring 7 having at least one row of openings, and a drive shaft 2. Through an annular nozzle 8 located ahead of spinning rotor 1 in the axial direction, said nozzle having an outlet opening facing the outer circumference of spinning rotor 1, a mixture 9 of hot gas particles is blown at rotating spinning rotor 1. The particles are fed from a particle collector 18. Rotating spinning rotor 1 generates a boundary layer flow at its surface, so that mixture 9 of hot gas particles strikes still-plastic fibers 10 as they emerge from nozzles 3. Particles of mixture 9 of hot gas particles stick to the surfaces of fibers 10.

Immediately after impacting the fibers 10, particles 17 pass through a high-voltage field 11, produced by applying a voltage to corona elements 12 and 13. This produces an electrostatic charge on the fibers that are now coated with particles. The charged, particle-coated fibers are conveyed by a suction flow generated by a suction hood located radially around spinning head 1, onto backing material 14 and covering material 15, and deposited thereon.

Figure 3:
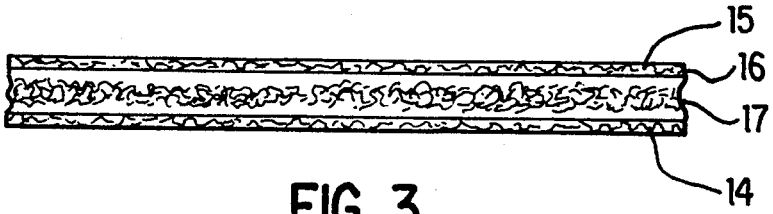
FIG. 3 is a sectional view illustrating the construction of the filter material.

FIG. 3 shows the structure of the filter material according to the invention. Embedded between a backing material 14 and covering material 15 is a layer of very fine fleece 16. Particles 17 are shown on this very fine fleece 16. The filtration-effective charges, which remain effective even after prolonged use of the textile as a filter because of the dipole effect of particles 17, are applied to the particle-coated, very fine fleece 16.

Figure 4:
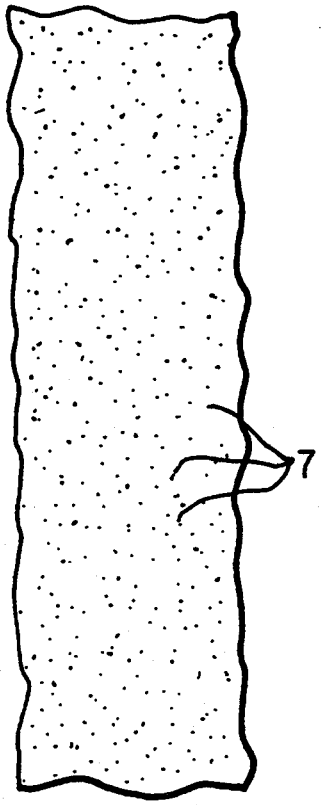
FIG. 4 is a considerably enlarged view of a fiber having barium titanate particles on its surface.

FIG. 4 is a schematic diagram showing a fiber made of polymer material on a considerably enlarged scale. Particles 17 located on the surface of the fiber provide good in-use properties for a long service life.

Figure 5:
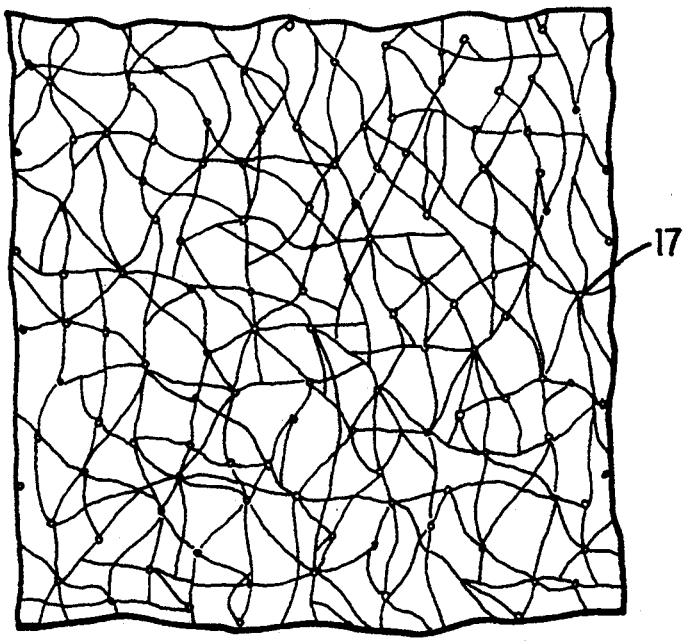
FIG. 5 is an enlargement of FIG. 4 in which barium titanate particles are shown schematically on the surface of the fiber.

FIG. 5 shows a considerably magnified section of the fiber in FIG. 4. In this figure, particles 17, which are arranged not as agglomerates but separately on the surface of the fiber, are clearly evident. By virtue of the method according to the invention, particles 17 are attached firmly to the surfaces of the fibers without adversely affecting the effective filtering surface.

We claim:

1. A method for manufacturing a flat textile structure, comprising:

heating a polymer to form a melt;

feeding the melt to a spinning rotor, from which are spun fibers from the melt, said spinning rotor forming a boundary flow layer as it spins; and directing an air stream that contains solid particles via the boundary layer flow that is generated by the spinning rotor to impact the fibers while the fibers are still sticky so that the particles coat the fibers.

2. The method according to claim 1, wherein immediately after the fibers are impacted by the particles, the particle coated fibers are exposed to ionizing radiation.

3. The method according to claim 1, further comprising the step of permitting the fibers to undergo shaping and solidification, wherein after shaping and solidification, the fibers are laid down continuously and progressively onto a backing surface.

4. An apparatus for generating fibers, comprising:

a spinning rotor displaceable around its axis in a rotary motion, said spinning rotor having outlet openings through which fibers emerge when the rotor is charged with a fiber forming material;

means for moving a backing material parallel to the axis of the spinning rotor, for continuously capturing the fibers emerging from the outlet openings;

means located axially adjacent to the spinning rotor for continuously supplying a gas to the outlet openings; and means for continuously feeding solid particles into the gas such that the gas containing the solid particles is propelled by the flowing boundary layer of gas that forms at the periphery of the spinning rotor in the direction of the backing material that is being propelled by the means for moving the backing material.

5. The apparatus according to claim 4, wherein the means for supplying a gas to the outlet openings comprises an annular nozzle located on that axial side of the spinning rotor which faces the direction from which the means for moving a backing material supplies said backing material, said annular nozzle having an outlet direction facing the outer circumference of the spinning rotor.

6. The apparatus according to claim 5, wherein the means for feeding particles comprises a particle collector located on that axial side of the spinning rotor which faces the direction from which the means for moving a backing material supplies said backing material, and has an outlet opening terminating in the annular nozzle.

7. The apparatus according to claim 6, further comprising means for varying the cross section of the outlet opening of the particle collector.

8. The apparatus according to claim 4, further comprising corona elements for electrostatic charging of fibers, said corona elements being located on either side of the plane of the outlet openings of the rotor and at a radial distance from the perimeter of the roller.

9. The apparatus according to claim 5, further comprising corona elements for electrostatic charging of fibers, said corona elements being located on either side of the plane of the outlet openings of the rotor and at a radial distance from the perimeter of the roller.

10. The apparatus according to claim 6, further comprising corona elements for electrostatic charging of fibers, said corona elements being located on either side of the plane of the outlet openings of the rotor and at a radial distance from the perimeter of the roller.

11. The apparatus according to claim 7, further comprising corona elements for electrostatic charging of fibers, said corona elements being located on either side of the plane of the outlet openings of the rotor and at a radial distance from the perimeter of the roller.

12. The apparatus according to claim 8, wherein the corona elements are annular.

13. The apparatus according to claim 8, wherein the corona elements are permanently mounted relative to the spinning rotor.

14. The apparatus according to claim 12, wherein the corona elements are permanently mounted relative to the spinning rotor.

15. A method for manufacturing a flat textile structure, comprising the steps of:

heating a polymer to form a melt;

feeding the melt to a spinning rotor having nozzles from which streams of the melt are flung so as to form fiber, said spinning rotor forming a boundary layer of gas as it spins;

charging an air stream with particles that can retain an electrical charge; and conveying the particle-charged air stream via the boundary layer to the polymer as the polymer exits the spinning rotor so that the particles coat the fibers.

16. An apparatus for manufacturing a fiber and particle impregnated web, comprising:

a spinning rotor displaceable around its axis in a rotary motion, said spinning rotor having outlet openings;

a web, movable parallel to the axis, for continuously capturing the fibers emerging from the outlet openings;

means for continuously supplying a gas to the outlet openings located axially adjacent to spinning rotor; and means for continuously feeding solid particles into the gas, wherein the gas supply means and the solid particle supply means are so located with respect to the spinning rotor that the solid particles are conveyed to the boundary layer that forms about the rotor as it spins.

17. An apparatus for manufacturing a fiber and particle impregnated web as set forth in claim 16, further comprising a means for generating a vacuum on that side of the web that is not impacted with particles and fibers so as to draw the fibers and particles to the web.

* * * * *